United States Patent [19]

Davis, Jr.

[11] Patent Number: 4,771,145

[45] Date of Patent: Sep. 13, 1988

[54] LIGHT SWITCH EXTENSION

[76] Inventor: Kenneth E. Davis, Jr., 3112 E. Siesta La., Phoenix, Ariz. 85024

[21] Appl. No.: 93,987

[22] Filed: Sep. 8, 1987

[51] Int. Cl.[4] ..... H01H 3/04

[52] U.S. Cl. ..... 200/331

[58] Field of Search ..... 200/331; 74/503

[56] References Cited

U.S. PATENT DOCUMENTS

| | | | |
|---|---|---|---|
| 2,146,146 | 2/1939 | Innis | 200/331 |
| 2,389,220 | 11/1945 | Tredeau | 200/331 |
| 2,461,614 | 2/1949 | Seaman | 200/331 |
| 2,466,820 | 4/1949 | Oberschmidt | 200/331 |
| 2,493,581 | 1/1950 | Hood | 74/503 |
| 2,668,456 | 2/1954 | Meistrell | 74/503 |
| 2,692,932 | 10/1954 | Parke et al. | 200/331 |
| 2,719,898 | 10/1955 | Allen | 200/331 |
| 2,724,032 | 11/1955 | Coletta | 200/331 |
| 2,726,303 | 12/1955 | Berndsen | 200/331 |
| 2,760,035 | 8/1956 | Friesen | 200/331 |
| 2,775,674 | 12/1956 | Meder | 200/331 |
| 2,919,334 | 12/1959 | Jones | 200/331 |
| 3,939,725 | 2/1976 | Fisher | 74/503 |
| 4,221,946 | 9/1980 | Halstrum | 200/331 |
| 4,295,026 | 10/1981 | Williams et al. | 200/331 |
| 4,454,401 | 6/1984 | Powis, Jr. | 200/331 |

FOREIGN PATENT DOCUMENTS

| | | | |
|---|---|---|---|
| 930780 | 7/1973 | Canada | 200/331 |

*Primary Examiner*—Renee S. Luebke

*Attorney, Agent, or Firm*—Warren F. B. Lindsley

[57] ABSTRACT

A light switch extension device for operating by a small child or wheelchair bound individual wherein the extension device employs a drive rod which is connected at one end to the toggle of a light switch by a pivotally mounted cap which slips over one end of the toggle and is pivotally connected at its other end to a cam wheel in the switch extension device which, when operated, moves the drive rod to turn the light switch "ON" or "OFF".

2 Claims, 1 Drawing Sheet

LIGHT SWITCH EXTENSION

BACKGROUND OF THE INVENTION

Light switches as normally positioned in the home are at too high a level to be reached and operated by small children and wheelchair bound individuals. This condition frequently causes problems. A resourseful child, for example, may move a chair or other object to the switch location and will then climb up to the switch to operate it. This often results in falls and injuries. Other children will be con-stantly asking someone to turn on the light for them.

These problems can be avoided through the use of a light switch extension device that is coupled to a conventional light switch and provides a control means at a low enough level to be operated by a small child or others.

DESCRIPTION OF THE PRIOR ART

The need for such a light switch extension is evidenced by the relatively large number of related devices described in the prior art.

U.S. Pat. No. 2,668,456 describes a switch operator for children which is attached to an existing switch in place of the switch cover. This device extends downwardly from the switch to a level that can be reached by a small child. At the lower end of the device, a toggle is pivotally mounted for operation by the child. The toggle is coupled to the light switch by a bar or plate, the upper end of which is slotted to receive the control arm of the light switch so that as the toggle is pivoted up or down, the light switch is turned on or off. The toggle together with the surrounding structure is animated to attract the interest of the child.

U.S. Pat. No. 2,919,334 also describes an extension operator for a light switch, again for use by small children. This patent is similar to that of U.S. Pat. No. 2,668,456 in its function, but differs in construction. U.S. Pat. No. 2,919,334 uses a cam that is rotated by the child to move the connecting bar up and down. The upper end of the connecting bar is coupled to the control arm of the light switch by means of a pair of rollers that are provided to prevent binding as the control arm pivots.

U.S. Pat. No. 3,939,725 discloses a remote switch actuating device that utilizes a flexible shaft confined in a tube or conduit to couple the actuating device to the electrical switch that is to be remotely operated. The actuating device is a conventional electrical switch without electrical connections.

The following additional U. S. and Canadian patents disclose light extension means of various types:

| | |
|---|---|
| 2,389,220 | 2,760,035 |
| 2,461,614 | 2,775,674 |
| 2,466,820 | 4,221,946 |
| 2,493,581 | 4,295,026 |
| 2,692,932 | 4,454,401 |
| 2,719,898 | 4,590,345 |
| 2,724,032 | Canada 930,780 |
| 2,726,303 | |

In spite of the apparent interest in such devices, none of them appear to have become widely used or commonly available in the marketplace. This is probably due to the relative complexity of their mechanical structures which result in high manufacturing costs and limited operating life.

What is needed, is a light switch extension that is simple in structure, reliable in operation and less expensive than the prior art.

SUMMARY OF THE INVENTION

In accordance with the invention claimed, an improved light switch extension device is provided which renders an existing light switch operable by a small child and wheelchair bound individuals. The extension device comprises an actuator that is mounted below the light switch at a level accessible by the child or others. The actuator is coupled to the toggle arm of the light switch by means of a drive rod so that as the toggle of the actuator switch is moved up or down, the toggle of the light switch follows and the light switch is accordingly turned on or off.

It is, therefore, an object of the present invention to provide an improved light switch extension device.

Another object of this invention is to provide such an extension device in a form that is accessible and operable by a small child or others.

A further object of this invention is to provide an actuator for such a device that resembles, as closely as possible, a conventional light switch so that the child will find sufficient satisfaction in its use and operation, and will not be tempted to climb up and operate the light switch directly.

A still further object of this invention is to provide such an extension device in as simple and inexpensive form as possible.

A still further object of this invention is to provide such an extension device that is by virtue of its simple mechanical structure inherently reliable and will, therefore, exhibit a long operating life.

Yet another object of this invention is to provide such an extension device in a form that may be easily mounted and coupled to an existing light switch.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
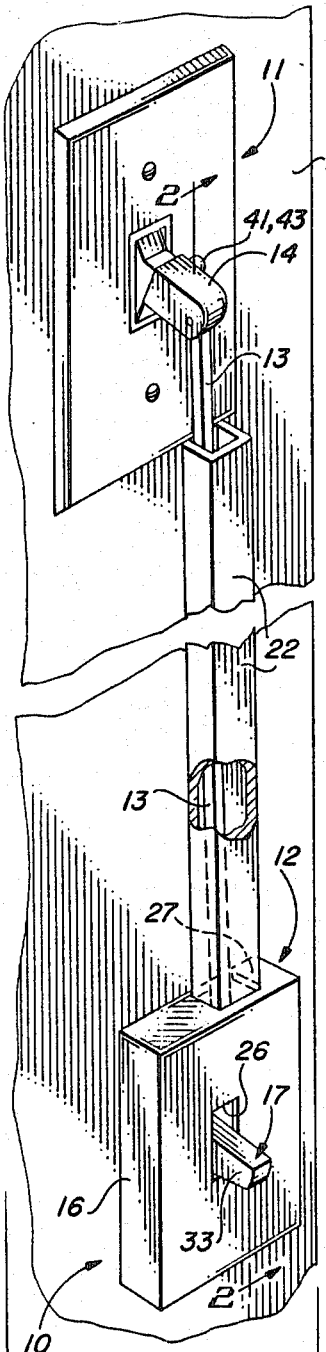
FIG. 1 is a perspective view showing the light switch extension device of the invention mounted upon the wall and coupled to a light switch in the manner of its intended use.

Referring more particularly to the drawing by characters of reference, FIGS. 1–5 disclose a light switch extension device 10 embodying the invention mounted on a wall directly below a conventional light switch 11. Switch 11 is coupled to device 10 so that when device 10 is operated by a small child or others, switch 11 is actuated thereby, and set to an "on" or an "off" position.

Device 10 comprises an actuator 12, a drive rod 13 and a toggle coupler 14, all of which are preferably molded at low cost from a suitable plastic material, which may closely resemble light switch 11.

Actuator 12 comprises a baseplate 15, a housing 16, a toggle 17 and a disc or cam wheel 18.

Baseplate 15 rests against a wall 20 when actuator 12 is mounted for use. Near its center is formed an integral hub 19 which is employed for the rotational mounting of cam wheel 18. Hub 19 is a raised or reinforced circular area of baseplate 15 surrounding a cylindrical opening 21 that is perpendicular to baseplate 15. The end of opening 21 facing wall 20 is flared or countersunk as a means for retaining a shaft of cam wheel 18. Housing 16 is intended to be detachably secured to wall 20 by a suitable Velcro connector comprising detachably engaging members 24 and 25.

Housing 16 is a rectangular box-like structure with one open side. The open side has a retaining rib 23 arranged about the inside of its periphery which fits around the outer edges of baseplate 15. Rib 23 prevents baseplate 15 from entering housing 16 to a depth exceeding the thickness of baseplate 15. A rectangular slot or opening 26 in the front panel of housing 16 is provided for mounting toggle 17 thereto, and another opening 27 is provided in the top wall of housing 16 so that drive rod 13 may extend therethrough. Opening 26 is positioned to the left of hub 19, and opening 27 is positioned to the right of hub 19 for reasons to be explained later.

Cam wheel 18 comprises a circular disc having a post or axle 29 extending axially therefrom in a substantially perpendicular direction. The outer end of axle 29 is flared to fit into the flared end of opening 21 of hub 19. To facilitate assembly and the mounting of cam wheel 18 in hub 19, axle 29 may be fabricated separately from cam wheel 18 and then inserted into opening 21 of hub 19 from its rear and then pressed into a center hole of cam wheel 18 where it may be secured by cementing. This construction is suggested in FIG. 4. As shown most clearly in FIG. 3, cam wheel 18 has two holes 31 and 32 positioned diametrically opposite each other near its outer edge, with hole 31 being engaged by toggle 17 and hole 32 being engaged by the lower end of drive rod 13.

Toggle 17 has an actuator arm 33 at one end, and a specially shaped engaging finger 34 at the other end. A transverse cylindrical opening 35 through the center of actuator arm 33 receives a pivot shaft 36, the ends of which are held by two spaced mounting tabs 37 that are integral with housing 16 and extend inwardly from the centers of the right and left-hand edges of opening 26. Actuator arm 33 has the appearance of a corresponding actuator arm of a conventional light switch. Finger 34 has the form of a short cylindrical rod 38 terminated in a spherical ball 39. Ball 39 and rod 38 engage hole 31 of cam 18 in the fully assembled actuator 12.

Drive rod 13 is a long plastic or metal rod with perpendicularly extending fingers 41 and 42 at its upper and lower ends, respectively. Fingers 41 and 42 are mutually perpendicular so that as finger 41 extends leftward as shown in FIG. 3 to engage the control arm of light switch 11, finger 42 extends forwardly from behind cam wheel 18 to engage hole 32 of disc 28.

Toggle coupler 14 comprises a plastic cap that slips over the actuator arm or toggle of a conventional light switch. Passing transversely part way through the crown of the cap is a cylindrical opening 43.

When coupler 14 is correctly slipped over the control arm of the switch, the axis of opening 43 is parallel with the axis of rotation of the toggle upon which coupler 14 is mounted. Opening 43 receives finger 41 of rod 13 which may be secured therein by a pin (not shown) which would pierce the cap from the opposite side and is driven into an interference hole in the end of finger 41. Finger 41 is freely rotational within opening 43 so that as rod 13 is moved vertically, causing the toggle of switch 11 to pivot about its axis, no significant degree of rotational resistance is offered by coupler 14.

Figure 2:
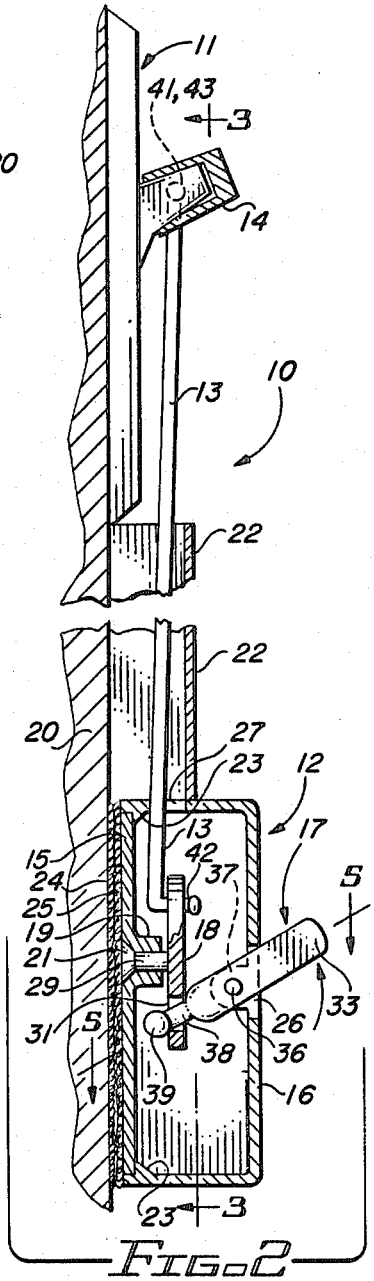
FIG. 2 is a cross-sectional view taken along line 2—2 of FIG. 1.
Figure 3:
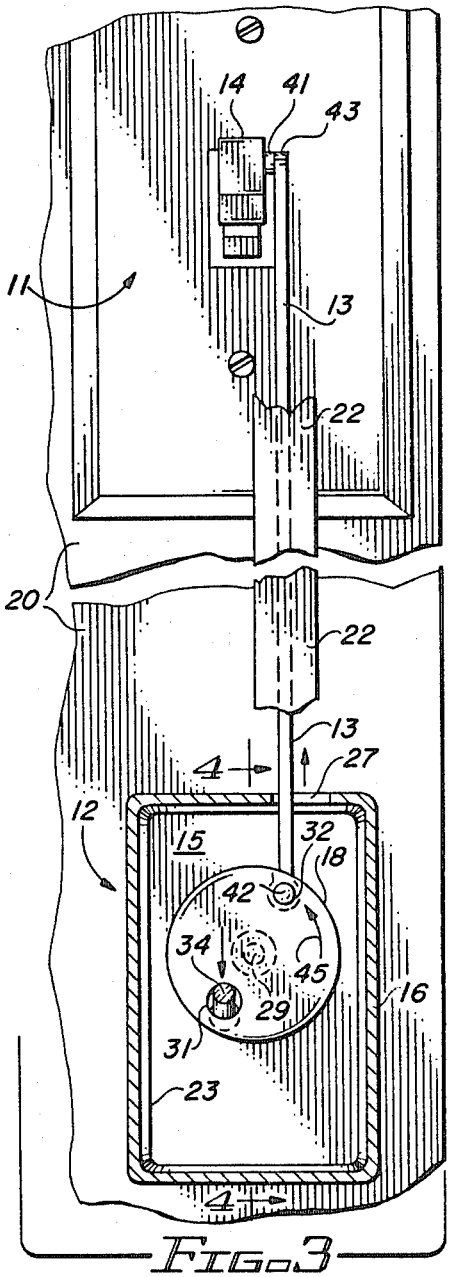
FIG. 3 is a cross-sectional view taken along line 3—3 of FIG. 2.
Figure 4:
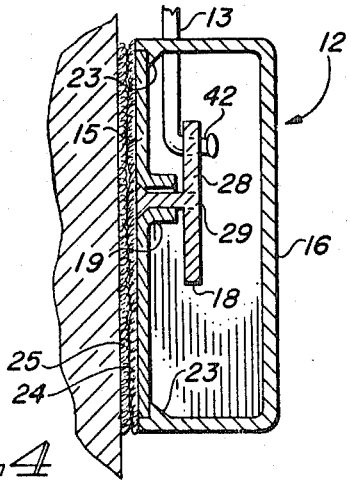
FIG. 4 is a cross-sectional view taken along line 4—4 of FIG. 3.
Figure 5:
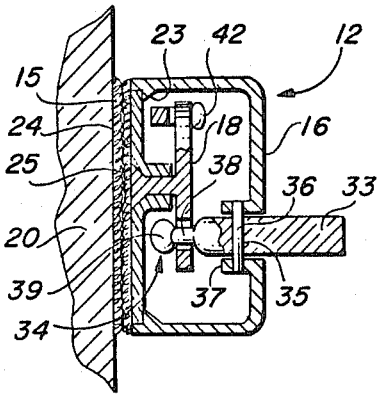
FIG. 5 is a cross-sectional view taken along line 5—5 of FIG. 2.

The operation of device 10 in its actuation of switch 11 is illustrated in FIGS. 2 and 3. As actuator arm 33 of toggle 17 is moved upward by the operator, toggle 17 pivots about its axis (shaft 36) so that finger 34 moves downward. Finger 34, moving downward and engaging hole 31 of cam wheel 18 causes wheel 18 to be rotated in a counterclockwise direction as indicated by arrow 45 in FIG. 3. As wheel 18 rotates counterclockwise, rod 13 moves upward causing the toggle of switch 11 to move upward to its "ON" position. The toggle of switch 11 has thus been shown to follow the upward action of toggle 17 of actuator 12.

If arm 33 is now moved downward by the operator, cam wheel 18 will be caused to rotate in a clockwise direction causing rod 13 to move downwardly, thereby moving the toggle of switch 11 downward to its "OFF" position, again following the action of toggle 17 of actuator 12.

To install device 10 for the operation of switch 11, coupler 14 is first slipped over the toggle of switch 11. Switch 11 and toggle 17 are then both set to the same position (both up or both down) and actuator 12 is positioned and aligned directly below switch 11 and secured to wall 20 by the Velcro connector. If desired, cover 22 may be used to cover rod 13 by detachably being affixed to wall 20.

A simple and inexpensive light switch extension is thus provided in accordance with the stated objects of the invention. The unique coupling arrangement afforded by coupler 14 eliminates the binding action that is inherent in some of the prior art devices. This arrangement also avoids the apparently higher costs involved in earlier solutions to this problem.

Although but a single embodiment of the invention has been illustrated and described, it will be apparent to those skilled in the art that various changes and modifications may be made therein without departing from the spirit of the invention or from the scope of the appended claims.

What is claimed is:

1. A light switch extension device for detachably mounting below a wall mounted conventional light switch having a face plate comprising:

an actuator resembling the face plate of the conventional light switch and incorporating a movable toggle for manipulation by an operator, a drive rod mounted for movement axially upwardly and downwardly in direct response to motion of said toggle of said actuator, and a coupler forming a cap for slipping over one end of a toggle of a light switch that is to be controlled by said extension device, said cap being pivotally coupled to the upper end of said drive rod, and means for pivotally connecting the lower end of said drive rod to said toggle of said actuator, said actuator comprising a cam wheel having first and second diametrically opposed engagement holes extending laterally therethrough, said first hole being engaged by said toggle of said actuator and said second hole being engaged by the lower end of said drive rod, whereby upward or downward pivotal motion of said toggle causes said cam wheel to rotate in a clockwise or a counterclockwise direction, respectively, and said clockwise or counterclockwise rotation of said cam wheel in turn causes said drive rod to be moved upward or downward following the motion of said toggle.

2. A light switch extension device for detachably mounting below a wall mounted conventional light switch having a face plate comprising:

an actuator resembling the face plate of the conventional light switch and incorporating a movable toggle for manipulation by an operator, a drive rod mounted for movement axially upwardly and downwardly in direct response to motion of said toggle of said actuator, and a coupler forming a cap for slipping over one end of a toggle of a light switch that is to be controlled by said extension device, said cap being pivotally coupled to the upper end of said drive rod, means for pivotally connecting the lower end of said drive rod to said toggle of said actuator, said actuator comprising a cam wheel having first and second diametrically opposed engagement holes extending laterally therethrough, said first hole being engaged by said toggle of said actuator and said second hole being engaged by the lower end of said drive rod, and a cover for said drive rod detachably secured to the wall supporting the light switch, whereby upward or downward pivotal motion of said toggle causes said cam wheel to rotate in a clockwise or a counterclockwise direction, respectively, and said clockwise and counterclockwise rotation of said cam wheel in turn causes said drive rod to be moved upward or downward following the motion of said toggle.

* * * * *